US007806656B2

(12) United States Patent
Chiu et al.

(10) Patent No.: US 7,806,656 B2
(45) Date of Patent: Oct. 5, 2010

(54) FAN ASSEMBLY FOR VEHICLE HEAT-DISSIPATING FAN AND FORMING METHOD THEREOF

(75) Inventors: Yung-Yu Chiu, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1284 days.

(21) Appl. No.: 11/316,969

(22) Filed: Dec. 27, 2005

(65) Prior Publication Data

US 2006/0257255 A1 Nov. 16, 2006

(30) Foreign Application Priority Data

May 13, 2005 (TW) ..... 94115567 A

(51) Int. Cl.
*F04D 29/64* (2006.01)

(52) U.S. Cl. ..... 415/214.1; 415/220; 29/889; 40/781; 403/349; 403/350; 403/353

(58) Field of Classification Search ..... 415/220, 415/213.1, 214.1, 222, 223, 207; 40/781; 403/348, 349, 350, 353; 29/889, 889.3, 889.4, 29/897.312

See application file for complete search history.

(56) References Cited

U.S. PATENT DOCUMENTS

| | | | | |
|---|---|---|---|---|
| 2,191,341 | A * | 2/1940 | Curley | 415/207 |
| 2,538,739 | A * | 1/1951 | Troller | 415/220 |
| 4,281,895 | A * | 8/1981 | Mohr | 403/348 |
| 4,532,672 | A * | 8/1985 | Anderson | 403/349 |
| 4,538,967 | A * | 9/1985 | Furukawa | 403/349 |
| 4,734,015 | A * | 3/1988 | Wrobel | 417/354 |
| 6,386,828 | B1 * | 5/2002 | Davis et al. | 415/147 |

* cited by examiner

*Primary Examiner*—Christopher Verdier
(74) *Attorney, Agent, or Firm*—Birch, Stewart, Kolasch & Birch, LLP

(57) ABSTRACT

A fan assembly comprises a frame and a securing element. The frame has a first end portion, a second end portion and a middle portion. The foam securing element comprises a positioning hole having a first hole having a shape corresponding to the first end portion, a second hole having a shape corresponding to the second end portion, and a third hole having a cross section larger than that of the second hole. When the second end portion is inserted into the first hole, the second end portion and the middle portion pass through the first hole and the first end portion urges against the periphery of the second hole to receive the second end portion in the third hole. The second end portion of the frame is stopped by a periphery of the positioning hole after rotating at a predetermined angle so that the frame is positioned.

16 Claims, 10 Drawing Sheets

FAN ASSEMBLY FOR VEHICLE HEAT-DISSIPATING FAN AND FORMING METHOD THEREOF

This non-provisional application claims priority under U.S.C. §119(a) on Patent Application No(s). 094115567 filed in Taiwan, Republic of China on May 13, 2005, the entire contents of which are hereby incorporated by reference.

BACKGROUND

The invention relates to a fan assembly, and in particular to a frame for receiving a vehicle heat-dissipating fan without screws or other mounting elements.

A fan is generally used to facilitate the circulation speed of air in a car. The fan, usually disposed on a mount in front of the driver, is actuated by connecting to a circuit system or a cigarette lighter of the car. However, the fan cannot effectively dissipate heat generated between the driver's backside and the seat, particularly when the car is operating in hot weather.

A ventilated seat is thus used for solving the described problem. The ventilated seat has a plurality of holes formed on the upper surface of the seat and a fan disposed under or inside the seat expels air from the rear or bottom of the seat to the exterior. Further, the fan can be controlled by an intelligent temperature-control system to automatically adjust the airflow rate according to the temperature of the seat.

In FIGS. 1A and 1B, a conventional fan 10 includes a frame 102 and four mounting holes 104 formed on the frame 102. The frame 102 is fixed securely on a hard part of the seat by screws (not shown in Figs.) via the mounting holes 104 so that the fan 10 is fixed on the seat.

The size of the frame 102, however, determines the size and position of the mounting holes, and correspondingly affects the size of the screws and increases assembly difficulty. Further, the clearance formed between the frame 102 and the seat causes vibration and noise during the operation of the fan 10.

SUMMARY

The invention provides a fan assembly without screws or other mounting elements to reduce vibration and noise during the operation of the fan.

A fan assembly of the invention includes a frame and a securing element. The frame has a first end portion, a second end portion and a middle portion connected to the first end portion and the second end portion. The securing element has a positioning hole for selectively receiving the frame therein. The positioning hole includes a first end urging on the first end portion and a second end receiving the second end portion. The second end portion of the frame is stopped by the periphery of the positioning hole after rotating at a predetermined angle so that the frame is positioned. Thus, operational vibration and noise during the operation of the fan can be reduced.

Also, the invention provides a method for forming a fan assembly. The method includes the steps of: providing a frame comprising a first end portion, a second end portion, and a middle portion connected to the first end portion and the second end portion; providing a securing element with a positioning hole; inserting the second end portion of the frame into the first hole of the securing element along a predetermined direction so as to allow the second end portion and the middle portion to pass through the first hole and urge the first end portion against a periphery of the second hole and to allow the second end portion to be received in the third hole; and positioning the frame by using the periphery of the positioning hole to stop the second end portion of the frame after rotating at a predetermined angle.

The middle portion of the frame has a cross section less than those of the first end portion and the second end portion, and the first end portion of the frame has a cross section greater than that of the second end portion. The first end portion functions as the air outlet of the frame and the second end portion functions as the air inlet of the frame.

Further, the invention also provides a foam securing element with a positioning hole. The positioning hole includes a first hole having a shape corresponding to the first end portion, a second hole having a shape corresponding to the second end portion, and a third hole having a cross section larger than the second hole. When the second end portion of the frame is inserted into the first hole of the securing element, the second end portion and the middle portion pass through the first hole and the first end portion urges against the periphery of the second hole to receive the second end portion in the third hole. The second end portion of the frame is stopped by the periphery of the positioning hole after rotating at a predetermined angle so that the frame is positioned.

DESCRIPTION OF THE DRAWINGS

The invention can be more fully understood by reading the subsequent detailed description and examples with references made to the accompanying drawings, wherein.

DETAILED DESCRIPTION

FIGS. 5A to 5D show a fan assembly "F" of the invention. The fan assembly "F" includes a frame 20 and a securing element 30. In this embodiment, the fan assembly F, preferably made of foam or other materials, can be used in a vehicle to expel heat to the exterior.

The securing element 30 is a multilayer structure, and the frame 20 used for receiving an impeller (not shown in Figs.) is fixed to the securing element 30.

Figure 1A:
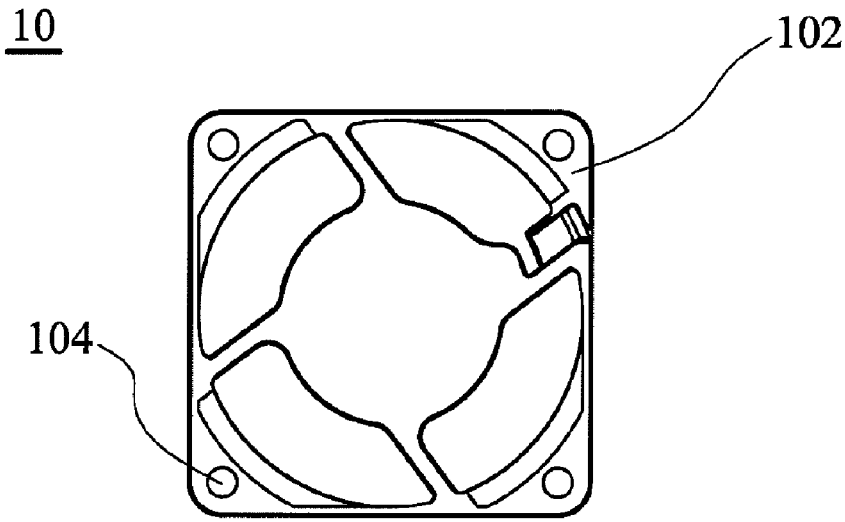
FIG. 1A ( PRIOR ART )
FIG. 1A is a top view of a conventional fan.
Figure 1B:
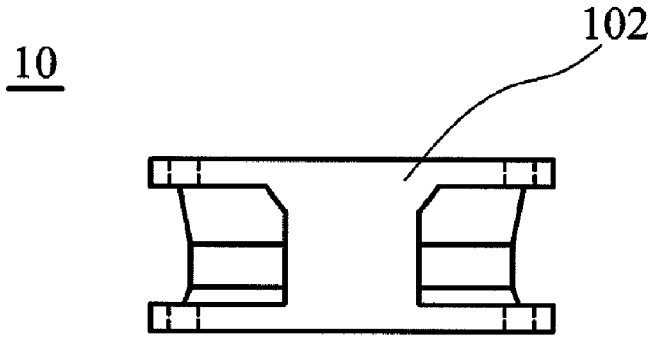
FIG. 1B ( PRIOR ART )
FIG. 1B is a side view of the fan in FIG. 1A.
Figure 2A:
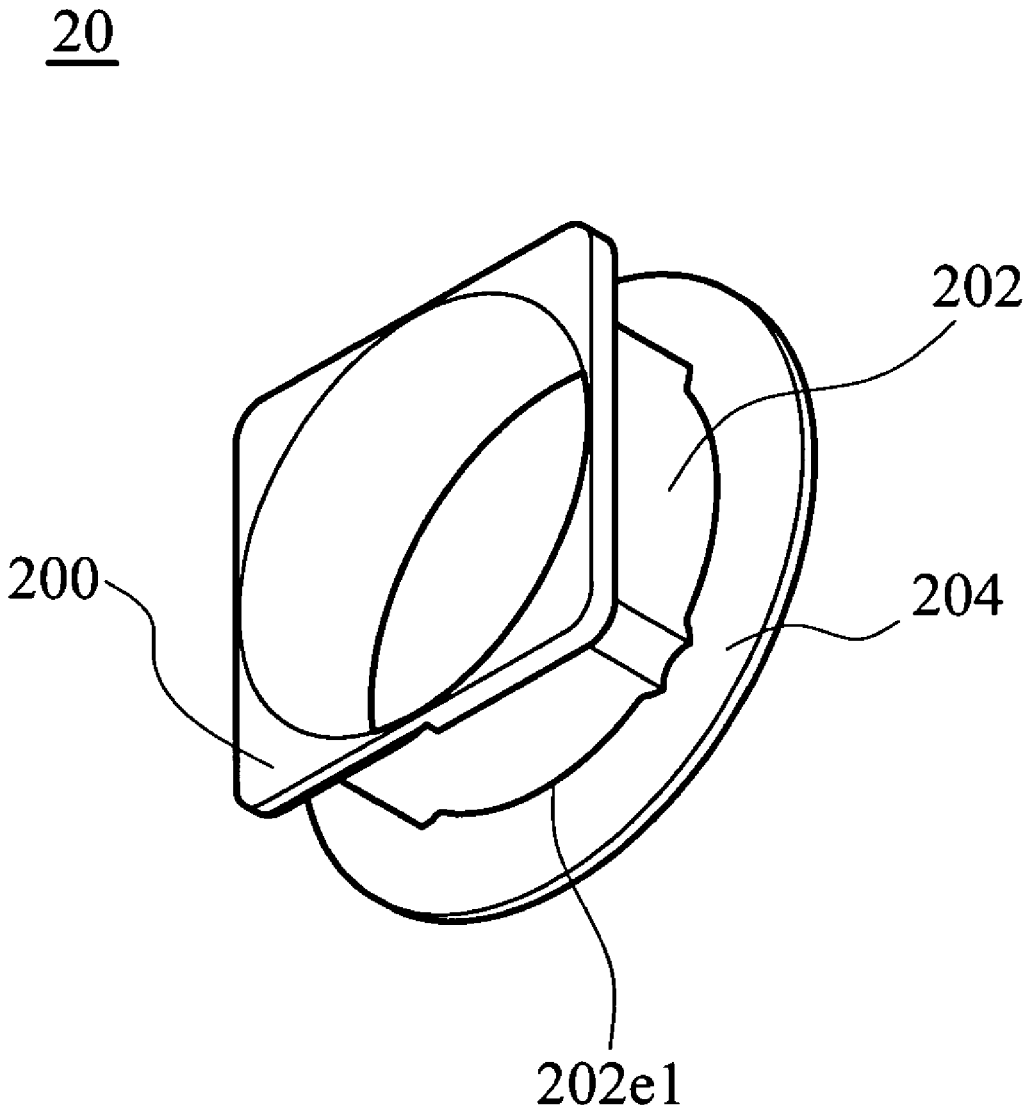
FIG. 2A and FIG. 2C are perspective views of a frame of the invention.
Figure 2B:
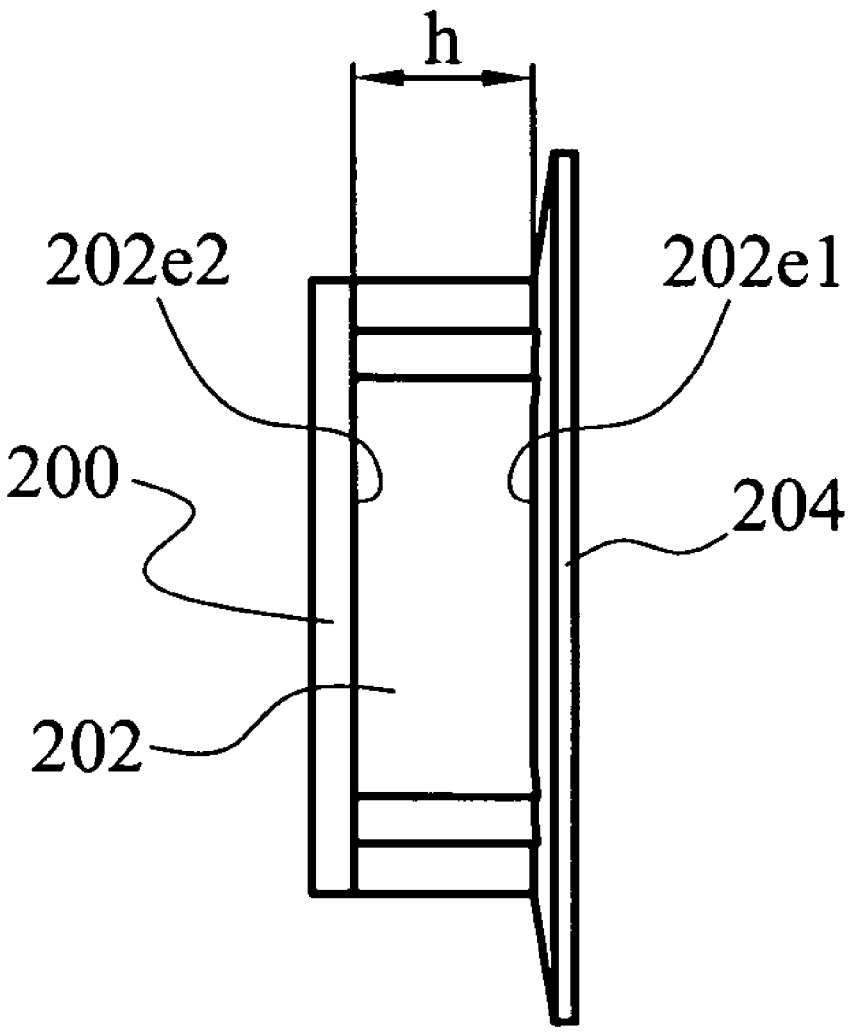
FIG. 2B is a side view of the frame of the invention in FIG. 2A.
Figure 2C:
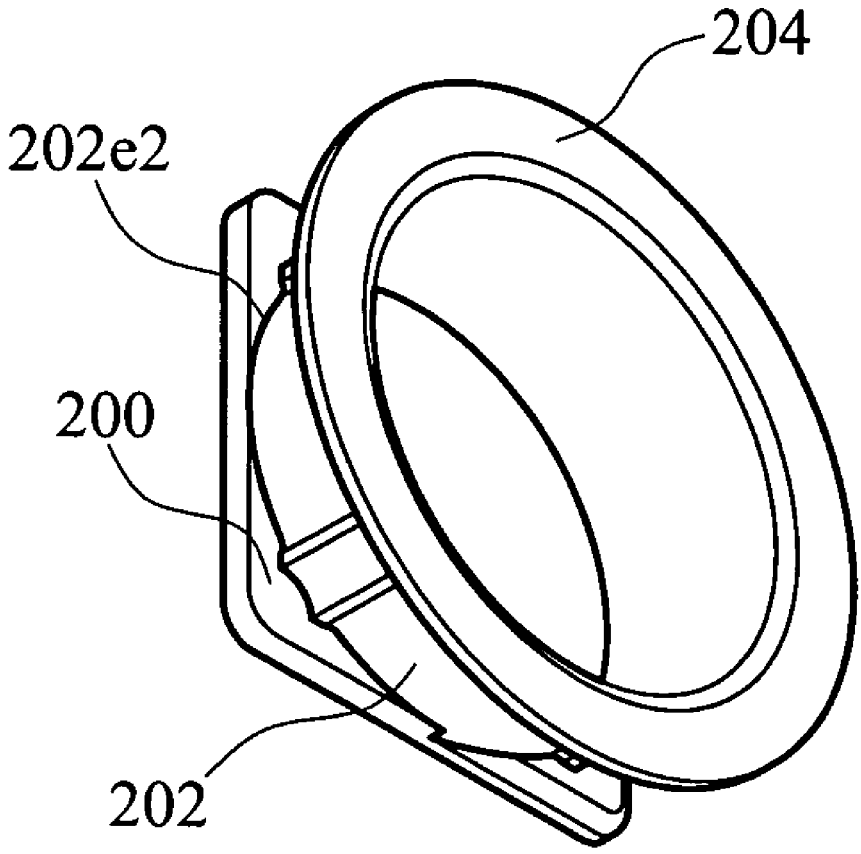

Referring to FIGS. 2A, 2B and 2C, the frame 20 includes a first end portion 204, a second end portion 200 and a middle portion 202. The ends 202e1, 202e2 of the middle portion 202 are connected to the first end portion 204 and the second end portion 200, respectively. In this embodiment, the first end portion 204 preferably functions as the air outlet of the frame 20 and the second end portion 200 functions as the air inlet of the frame 20.

The first end portion 204 has a round shape and the second end portion 200 has a square shape. The middle portion 202 has a cross section less than those of the first end portion 204 and the second end portion 200, and the second end portion 200 has a cross section less than and geometrically different from that of the first end portion 204. In this embodiment, the middle portion 202 has a cross section with a round shape. More specifically, in FIGS. 2A and 2C, the cross section of the first end portion 204 is a circular region formed between two circular profiles with different sizes therebetween, and the cross section of the second end portion 200 is a region formed between an outer square profile and an inner circular profile located inside the outer square profile.

In FIGS. 3A, 3B, 3C and 3D, the securing element 30 has a positioning hole 32, a first layer 301 with a first hole 321, a second layer 302 with a second hole 322 and a third layer 303 with a third hole 323. The second layer 302 is sandwiched between the first layer 301 and the third layer 303, and the positioning hole 32 formed by the first, second and third holes 321, 322 and 323 is an irregular through hole for receiving the frame 20. The first hole 321 and the third hole 323 serving as both ends of the positioning hole 32, respectively.

Figure 4A:
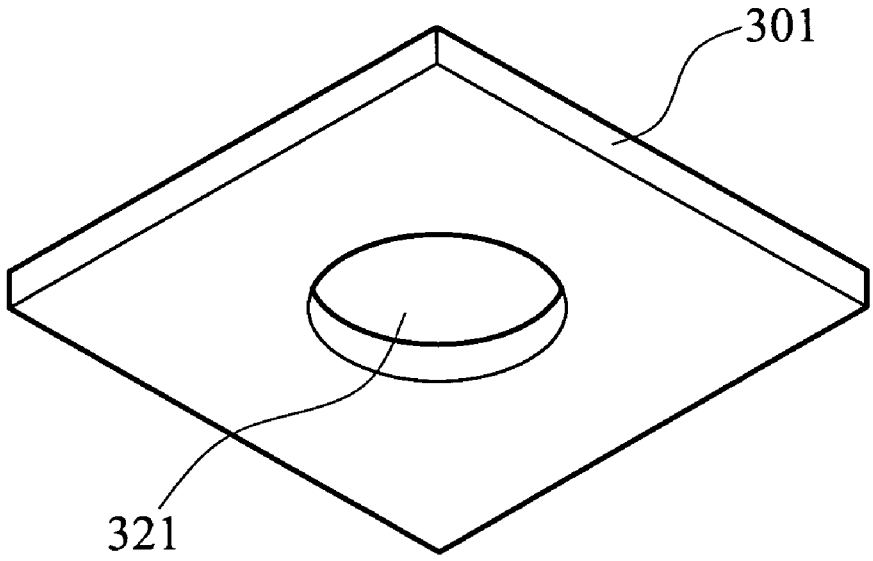
FIG. 4A is a perspective view of the first layer of the securing element of FIG. 3A.

In FIG. 4A, the first hole 321 of the first layer 301 has a cross section with a round shape which corresponds to the cross section of the first end portion 204 of the frame 20 so that the first end portion 204 of the frame 20 is exactly received and is accommodated within the first hole 321 of the first layer 301

Figure 3A:
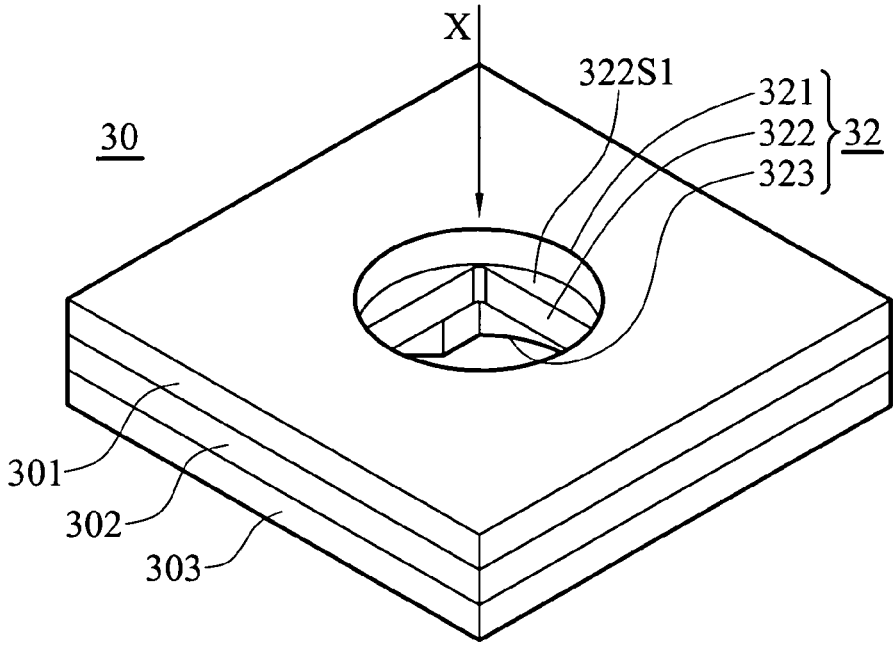
FIG. 3A is a perspective view of a securing element of the invention, wherein the securing element includes a first layer, a second layer and a third layer.
Figure 3B:
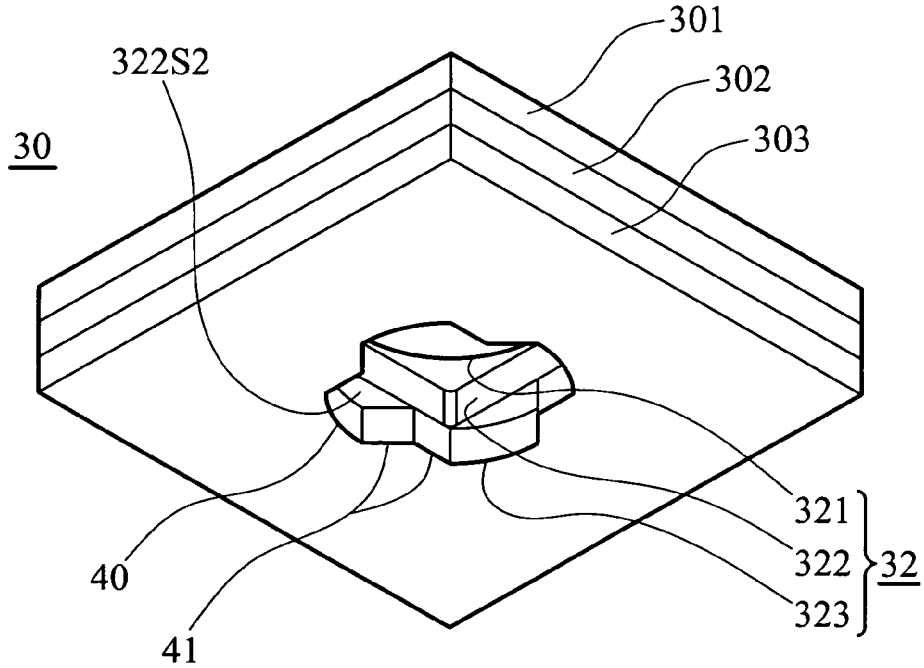
FIG. 3B is a perspective view of the securing element of FIG. 3A when the securing element is reversely disposed.
Figure 3C:
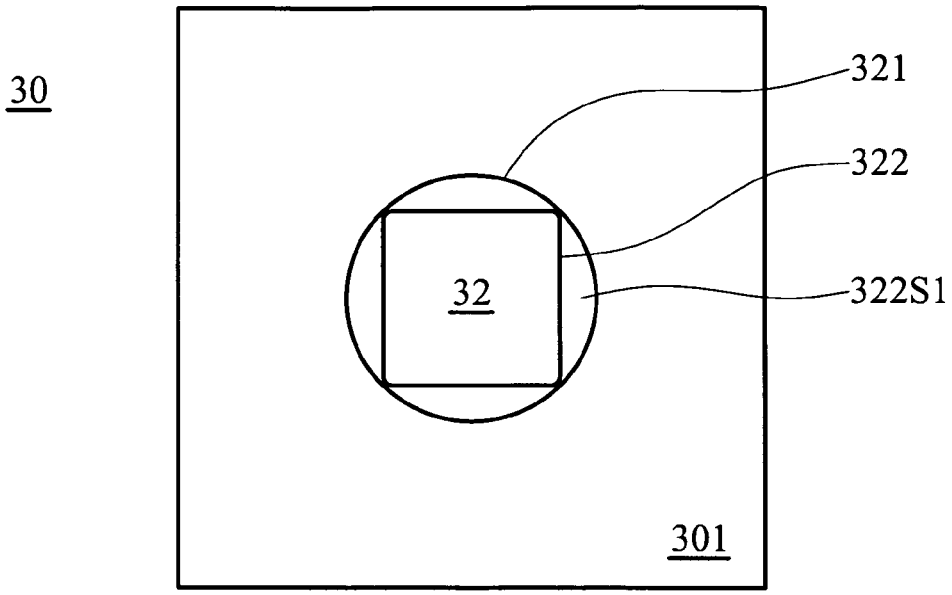
FIG. 3C is a top view of the securing element of FIG. 3A.
Figure 3D:
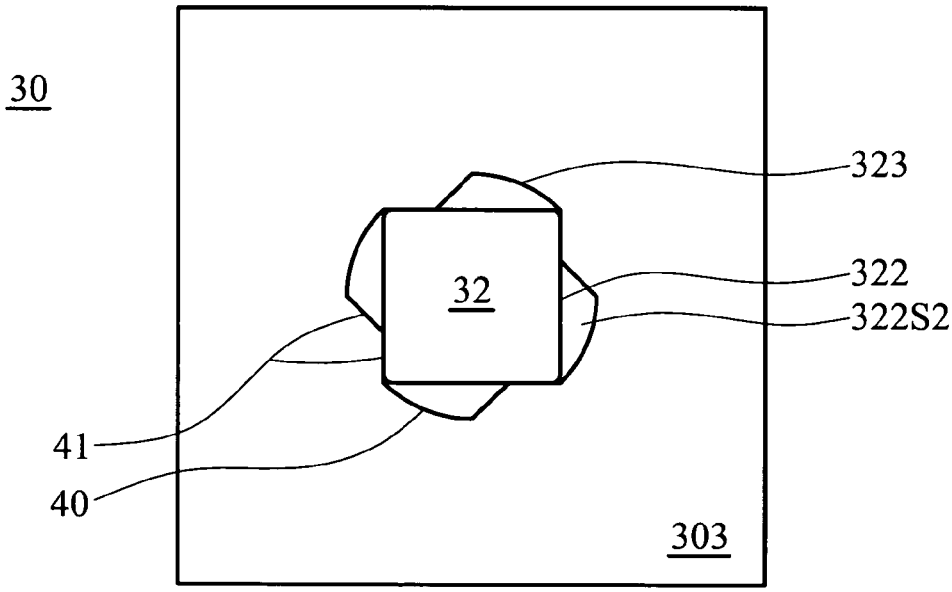
FIG. 3D is a bottom view of the securing element of FIG. 3A.
Figure 4B:
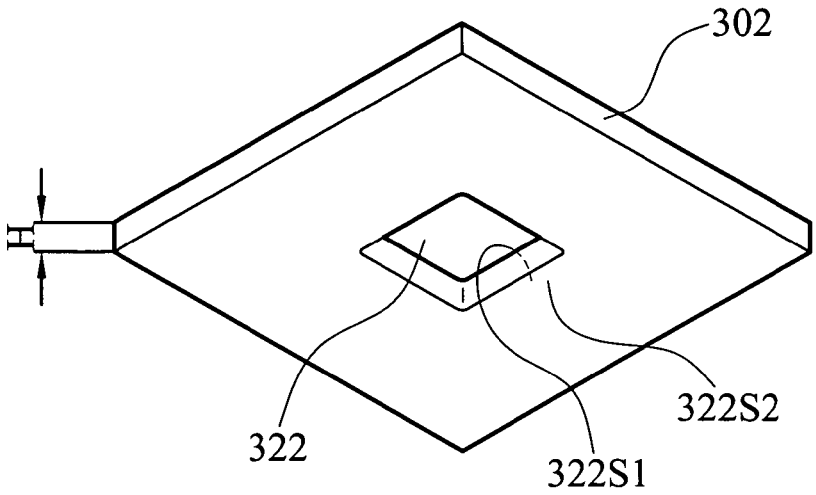
FIG. 4B is a perspective view of the second layer of the securing element of FIG. 3A.

In FIG. 4B, the second hole 322 of the second layer 302 has a cross section with a square shape which corresponds to the cross section of the second end portion 200 of the frame 20. Referring to FIG. 2B, FIG. 3A and FIG. 4B, when the second end portion 200 of the frame 20 is inserted into the first hole 321 of the securing element 30 along a predetermined direction "X" (As shown in FIG. 3A), the first hole 321 of the securing element 30 allows the second end portion 200 and the middle portion 202 to pass therethrough and to urge the first end portion 204 against the periphery of the second hole 302 so that the second end portion 200 is received and accommodated within the third hole 303.

The depth H of the second hole 322 is substantially equal to the depth h of the middle portion 202. Thus, the second end portion 200 extends from the second hole 322 when the middle portion 202 is disposed in the second hole 322. Also, the second hole 322 of the second layer 302 prevents the first end portion 204 of the frame 20 from passing there through.

Figure 4C:
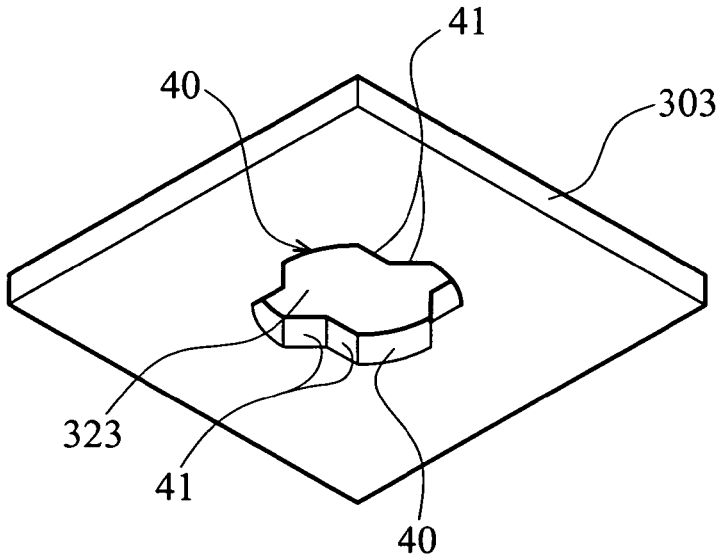
FIG. 4C is a perspective view of the third layer of the securing element of FIG. 3A.
Figure 5A:
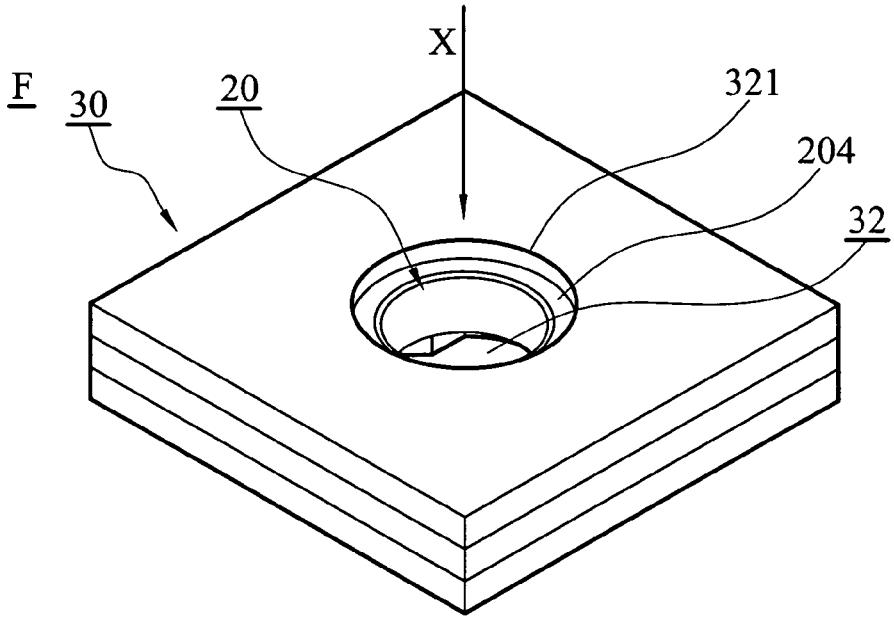
FIG. 5A and FIG. 5B are perspective views of a fan assembly of the invention.
Figure 5B:
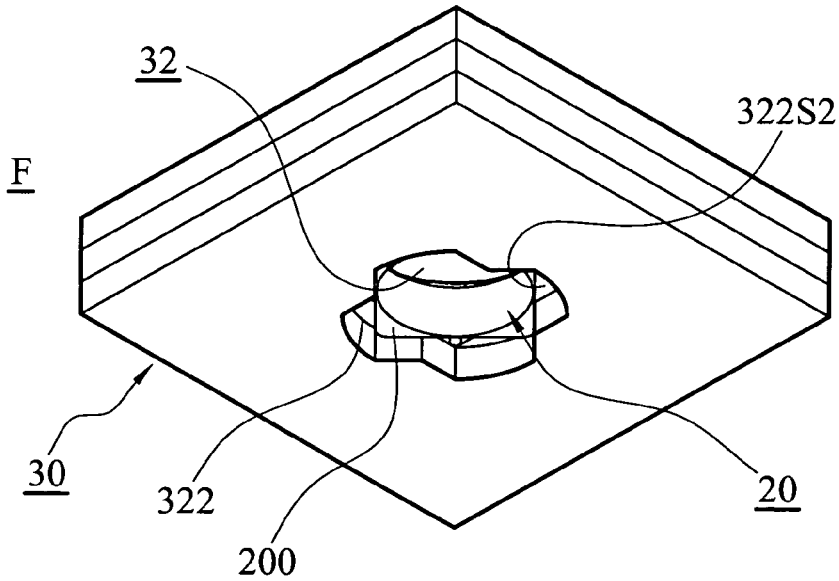
Figure 5C:
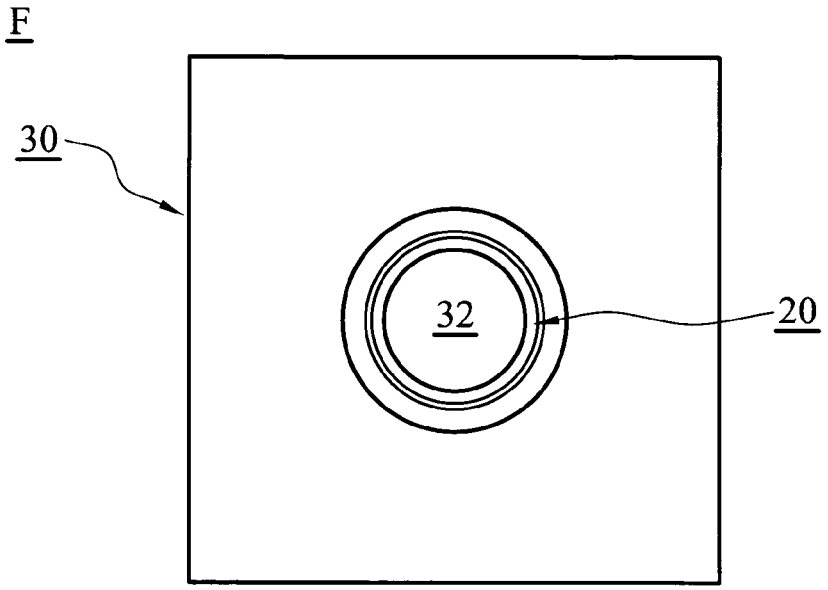
FIG. 5C is a top view of the fan assembly of FIG. 5A.
Figure 5D:
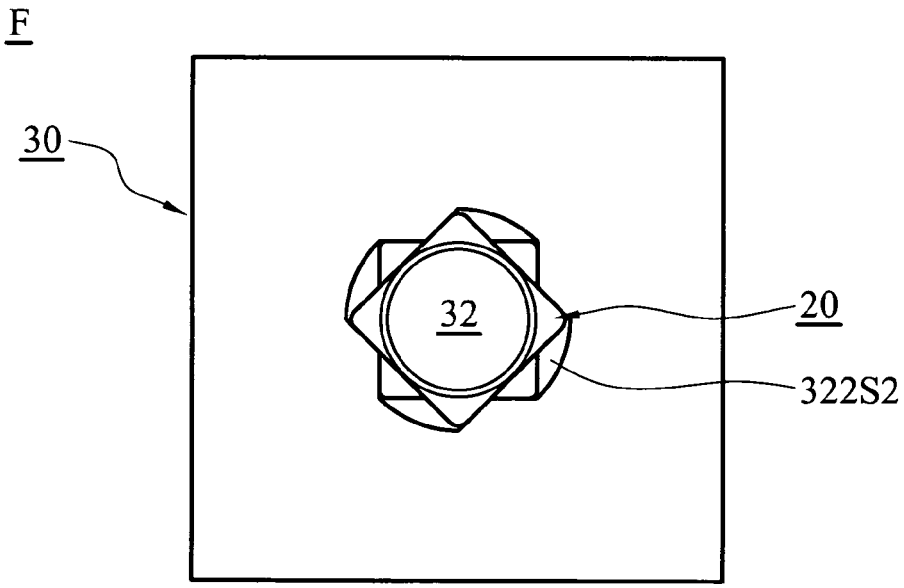
FIG. 5D is a bottom view of the fan assembly of FIG. 5A.

In FIG. 4C, the third hole 323 of the third layer 303 has a cross section with an irregular shape which is greater than the cross section of the second hole 322, so that the second end portion 200 of the frame 20 can be received in the third hole 323. Further, the third hole 323 has a plurality of first edges 40 and second edges 41 alternately disposed around the inner periphery of the third hole 323.

Referring to FIGS. 5A to 5D, which are perspective views of a fan assembly "F" including the frame 20 and the securing element 30. When the second end portion 200 of the frame 20 is inserted into the positioning hole 32 of the securing element 30, the second end portion 200 and the middle portion 202 both have a cross section less than that of the first end portion 204 so that the second end portion 200 and the middle portion 202 of the frame 20 are both able to pass through the first hole 321 of the first layer 301 of the securing element 30. The second hole 322 allows the second end portion 200 and the middle portion 202 to be passed therethrough but stops the first end portion 204, so that the first end portion 204 is received in the first hole 321 and urges against the periphery 322S2 of the second hole 322. Because the depth H of the second hole 322 corresponds to the depth h of the middle portion 202, the middle portion 202 is exactly received in the second hole 322 and the second end portion 200 is exactly received in the third hole 323 after the second end portion 200 passes through the second hole 322.

The first hole 321 of the securing element 30 has a round shape, so that the frame 20 received in the positioning hole 32 of the securing element 30 is able be be freely rotated clockwise or counterclockwise in the direction perpendicular to the predetermined direction "X". When the second end portion 200 contacts the second edges 41 of the third hole 323, the second end portion 200 of the frame 20 is stopped by the second end 323 of the positioning hole 32 after rotating at a predetermined angle, i.e., the second end portion 200 contacting the second edge 41 of the third hole 323 also contacts the periphery 322S2 of the second hole 322 of the second layer 302. Thus, the second end portion 200 of the frame 20 is prevented from moving out of the securing element 30 when the second end portion 200 contacts the edge 41 of the third hole 323 and urges against the periphery 322S2 of the second hole 322.

Note that the first end portion 204 can function as the air inlet and the second end portion 200 can function as the air outlet, and vice versa. Also, it is to be understood that the shape, size and position of the first end portion and the second end portion is not limited to the above-mentioned embodiments. The frame disclosed in the embodiments can accommodate an impeller therein and directly connect to the hard part of the vehicle without screws or other mounting elements. Therefore, it is effectively reduced the vibration and noise during the operation of the fan.

While the invention has been described with respect to preferred embodiment, it is to be understood that the invention is not limited thereto, but, on the contrary, is intended to accommodate various modifications and equivalent arrangements included within the spirit and scope of the appended claims.

What is claimed is:

1. A fan assembly, comprising:

a frame comprising a first end portion, a second end portion, and a middle portion connected to the first end portion and the second end portion; and a securing element with a positioning hole for selectively receiving the frame therein, wherein the positioning hole of the securing element comprises a first hole for receiving the first end portion of the frame and a second hole for receiving the middle portion of the frame, a shape of the first end portion of the frame corresponds to a shape of the first hole of the positioning hole of the securing element, a shape of the second end portion of the frame corresponds to a shape of the second hole of the positioning hole of the securing element, and the second end portion of the frame is stopped by a periphery of the positioning hole of the securing element after rotating at a predetermined angle so that the frame is positioned.

2. The fan assembly as claimed in claim 1, wherein the middle portion of the frame has a cross section less than those of the first end portion and the second end portion of the frame, and the first end portion of the frame has a cross section greater than that of the second end portion of the frame.

3. The fan assembly as claimed in claim 1, wherein the positioning hole of the securing element further comprises a third hole for receiving the second end portion of the frame.

4. The fan assembly as claimed in claim 1, wherein the first end portion of the frame comprises a round shape and the second end portion of the frame comprises a square shape.

5. The fan assembly as claimed in claim 1, wherein the first hole of the positioning hole of the securing element comprises a round shape and the second hole of the positioning hole of the securing element comprises a square shape.

6. The fan assembly as claimed in claim 1, wherein a depth of the second hole is substantially equal to a depth of the middle portion.

7. The fan assembly as claimed in claim 1, wherein the first end portion of the frame comprises a round shape and the second end portion of the frame comprises a square shape, the first hole of the positioning hole of the securing element comprises a round shape and the second hole of the positioning hole of the securing element comprises a square shape, a depth of the second hole of the positioning hole of the securing element is substantially equal to a depth of the middle portion of the frame, and the middle portion of the frame comprises a cross section with a round shape.

8. The fan assembly as claimed in claim 1, wherein the first end portion of the frame is an air inlet and the second end portion of the frame is an air outlet, or the first end portion of the frame is an air outlet and the second end portion of the frame is an air inlet.

9. The fan assembly as claimed in claim 1, wherein the securing element comprises foam.

10. A method for forming a fan assembly, comprising the steps of:

providing a frame comprising a first end portion, a second end portion, and a middle portion connected to the first end portion and the second end portion, wherein the middle portion of the frame has a cross section less than those of the first end portion and the second end portion, and the first end portion of the frame has a cross section greater than that of the second end portion;

providing a securing element with a positioning hole comprising a first hole, a second hole and a third hole, wherein a shape of the first hole corresponds to a shape of the first end portion, a shape of the second hole corresponds to a shape of the second end portion, and the third hole has a cross section larger than the second hole;

inserting the second end portion of the frame into the first hole of the securing element along a predetermined direction so as to allow the second end portion and the middle portion to pass through the first hole and urge the first end portion against a periphery of the second hole and to allow the second end portion to be received in the third hole; and positioning the frame by using a periphery of the positioning hole to stop the second end portion of the frame after rotating at a predetermined angle.

11. The method for forming the fan assembly as claimed in claim 10, wherein the third hole further comprises an edge for preventing the second end portion of the frame from moving out of the securing element in a reverse direction of the predetermined direction when the second end portion contacts the edge of the third hole and urges against the periphery of the second hole.

12. The method for forming the fan assembly as claimed in claim 10, wherein a depth of the second hole is substantially equal to a depth of the middle portion.

13. The method for forming the fan assembly as claimed in claim 10, wherein the first end portion of the frame comprises a round shape and the second end portion comprises a square shape.

14. The method for forming the fan assembly as claimed in claim 13, wherein the securing element comprises foam.

15. The method for forming the fan assembly as claimed in claim 10, wherein the first end portion of the frame is an air inlet and the second end portion is an air outlet, and vice versa.

16. A fan assembly, comprising:

a frame comprising a first end portion, a second end portion, and a middle portion connected to the first end portion and the second end portion; and a securing element with a positioning hole for selectively receiving the frame therein, wherein the positioning hole of the securing element comprises a first hole for receiving the first end portion of the frame and a second hole for receiving the middle portion of the frame, a depth of the second hole of the positioning hole of the securing element is substantially equal to a depth of the middle portion of the frame, and the second end portion of the frame is stopped by a periphery of the positioning hole of the securing element after rotating at a predetermined angle so that the frame is positioned.

* * * * *